US007523746B2

(12) United States Patent
Brusoe et al.

(10) Patent No.: US 7,523,746 B2
(45) Date of Patent: Apr. 28, 2009

(54) FUEL DELIVERY MODULE FOR LOW INSTALLATION HEIGHT APPLICATIONS

(75) Inventors: Mike Brusoe, Belleville, MI (US); Dieter Hagist, Lahnstein (DE)

(73) Assignee: Continental Automotive Systems US, Inc., Auburn Hills, MI (US)

( * ) Notice: Subject to any disclaimer, the term of this patent is extended or adjusted under 35 U.S.C. 154(b) by 0 days.

(21) Appl. No.: 11/797,268

(22) Filed: May 2, 2007

(65) Prior Publication Data

US 2008/0216800 A1 Sep. 11, 2008

Related U.S. Application Data

(60) Provisional application No. 60/797,546, filed on May 4, 2006.

(51) Int. Cl.
*F02M 37/00* (2006.01)
*F02M 37/04* (2006.01)

(52) U.S. Cl. ..... 123/509; 123/510

(58) Field of Classification Search ..... 123/509, 123/510; 417/423.3, 423.9, 423.15
See application file for complete search history.

(56) References Cited

U.S. PATENT DOCUMENTS 4,684,463 A * 8/1987 Mizusawa ..... 210/172.3
4,878,518 A * 11/1989 Tuckey ..... 137/448
5,237,977 A 8/1993 Tuckey
5,267,475 A * 12/1993 Gaston ..... 73/319
5,394,902 A * 3/1995 Shibao ..... 137/565.17
5,452,701 A * 9/1995 Tuckey ..... 123/509
5,732,684 A * 3/1998 Thompson ..... 123/514
6,000,913 A * 12/1999 Chung et al. ..... 417/53
6,014,957 A 1/2000 Robinson
6,609,503 B1 * 8/2003 Nakagawa et al. ..... 123/509
6,655,363 B2 * 12/2003 Kobayashi et al. ..... 123/509
6,761,193 B1 7/2004 Cotton
6,907,865 B1 * 6/2005 Hanby ..... 123/509
6,966,305 B2 * 11/2005 Aubree et al. ..... 123/509
7,275,523 B2 * 10/2007 Kimura et al. ..... 123/509
7,418,950 B2 * 9/2008 Teets et al. ..... 123/509
2007/0113830 A1 * 5/2007 Koito et al. ..... 123/509

FOREIGN PATENT DOCUMENTS

EP 0378896 A2 7/1990
EP 0941885 A2 9/1999

* cited by examiner

*Primary Examiner*—Thomas N Moulis

(57) ABSTRACT

A fuel delivery module 14 and fuel tank combination includes a fuel tank 16 for a vehicle. The fuel tank has a top wall 25 and a bottom surface 20. A fuel pump 18 is disposed in the fuel tank. The fuel pump has an axis A disposed generally at an acute angle α with respect to the bottom surface of the fuel tank. A fuel filter 22 is disposed in the fuel tank generally adjacent to the fuel pump. A flange 23 is mounted to the top wall 25 of the fuel tank.

17 Claims, 2 Drawing Sheets

FUEL DELIVERY MODULE FOR LOW INSTALLATION HEIGHT APPLICATIONS

This application claims the benefit of the earlier filing date of U.S. Provisional Application No. 60/797,546, filed on May 4, 2006, which is incorporated by reference herein in its entirety.

FIELD OF THE INVENTION

This invention relates to fuel supply systems for vehicles and, more particularly, to a fuel delivery module for use in low height applications.

BACKGROUND OF THE INVENTION

For shallow fuel tanks such as saddle tanks for vehicles, conventional fuel delivery modules are too tall since the fuel pump 12 is mounted vertically. More particularly, with reference to FIG. 1, the height H of the conventional fuel delivery module 10 is too large for such applications. Compressing the height H of the conventional fuel delivery module results in interferences and therefore cannot be packaged in an acceptable manner.

Thus, there is a need to provide a fuel delivery module that is can be suitably packaged in a low profile fuel tank such as a saddle tank.

SUMMARY OF THE INVENTION

An object of the invention is to fulfill the need referred to above. In accordance with the principles of the present invention, this objective is achieved by providing a fuel delivery module constructed and arranged to be mounted in a fuel tank of a vehicle. The module includes a fuel pump having an axis constructed and arranged to be disposed generally at an acute angle with respect to a bottom surface of the fuel tank. A fuel filter is constructed and arranged to be disposed generally adjacent to the fuel pump. A flange is constructed and arranged to be mounted to a top wall of the fuel tank.

In accordance with another aspect of the invention, a fuel delivery module and fuel tank combination includes a fuel tank having a top wall and a bottom surface. A fuel pump is disposed in the fuel tank. The fuel pump has an axis disposed generally at an acute angle with respect to the bottom surface of the fuel tank. A fuel filter is disposed in the fuel tank generally adjacent to the fuel pump. A flange is mounted to the top wall of the fuel tank.

In accordance with yet another aspect of the invention, a method is provided for mounting a fuel delivery module in a fuel tank. The method provides a fuel delivery module having a fuel pump, a fuel filter, and a flange associated with the fuel pump and the fuel filter. The fuel pump is mounted within a fuel tank so that an axis of the fuel pump is disposed at an angle less than 90 degrees with respect to a bottom of the fuel tank. The fuel filter is mounted in the fuel tank generally adjacent to the fuel pump. The flange is mounted to a top wall of the fuel tank.

Other objects, features and characteristics of the present invention, as well as the methods of operation and the functions of the related elements of the structure, the combination of parts and economics of manufacture will become more apparent upon consideration of the following detailed description and appended claims with reference to the accompanying drawings, all of which form a part of this specification.

BRIEF DESCRIPTION OF THE DRAWINGS

The invention will be better understood from the following detailed description of the preferred embodiments thereof, taken in conjunction with the accompanying drawings, wherein like reference numerals refer to like parts, in which.

DETAILED DESCRIPTION OF THE EXEMPLARY EMBODIMENT

Figure 1:
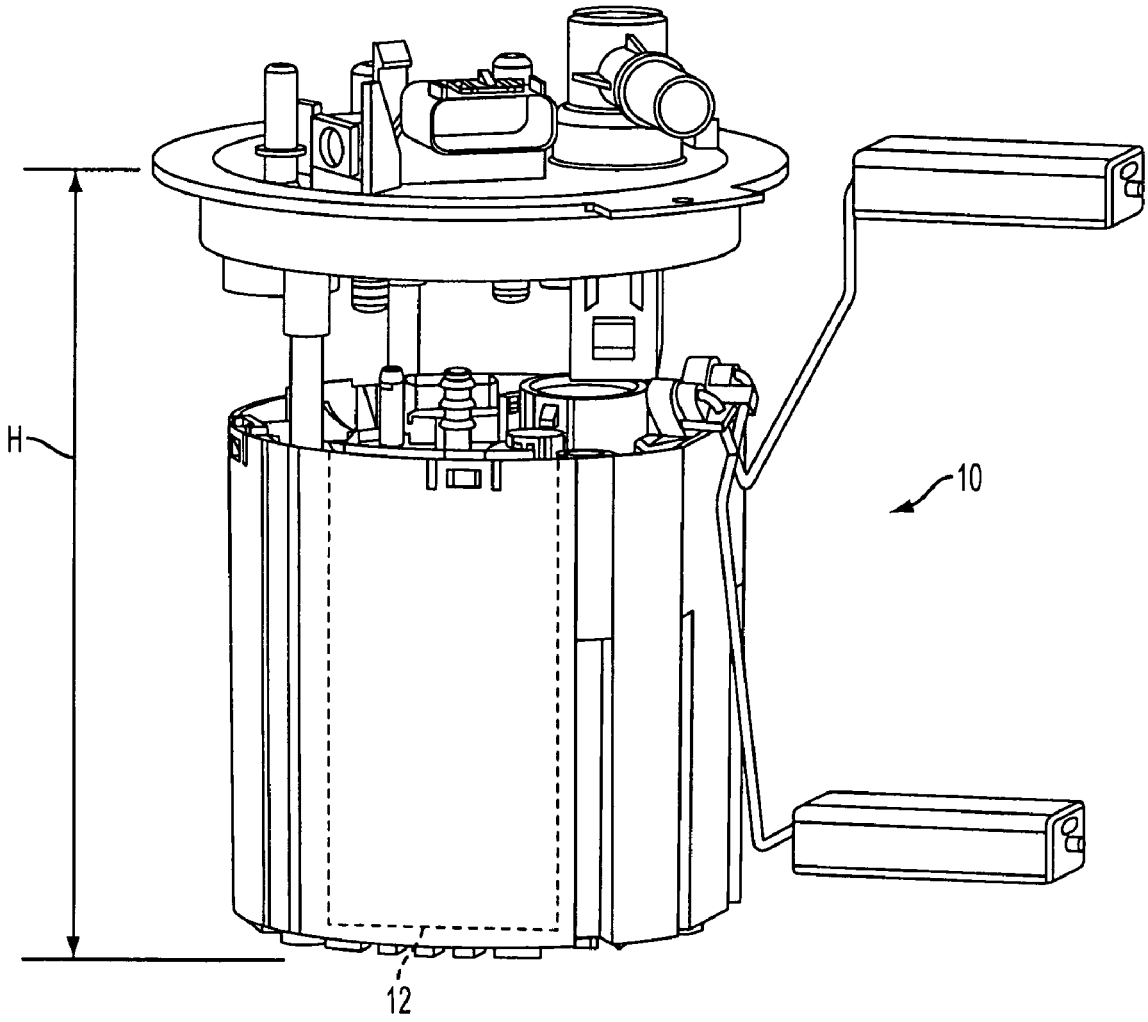
FIG. 1 PRIOR ART
FIG. 1 is a view of conventional fuel delivery module having a height H.

With reference to FIG. 1, a fuel delivery module is shown, generally indicated at 14, in accordance with an embodiment of the invention, shown mounted in a portion of fuel tank 16. The fuel tank 16 is of the low-profile saddle type having a first chamber 29 and a second chamber 31, with the second chamber having a certain height D. Although the tank 16 is shown to be of the saddle type, the tank 16 can be of any low-profile configuration.

Figure 3:
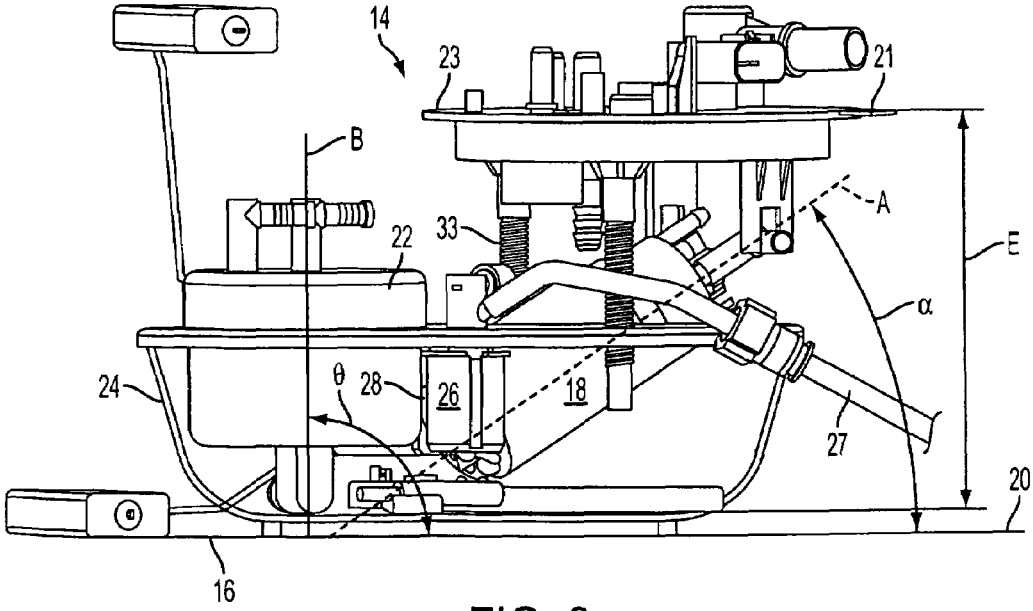
FIG. 3 is an enlarged view of the fuel delivery module of FIG. 2 shown with a reservoir thereof in a manner so as to see internal components.

As best shown in FIG. 3, in order to package the module 14 in the low-profile fuel tank 16 (e.g., in chamber 31), a fuel pump 18 has an axis A that is disposed at an angle $\alpha$ with respect to a bottom surface 20 of the tank 16. The angle $\alpha$ is preferably an acute angle, but can be equal to 0 degrees. Thus, the fuel pump 18 can be mounted horizontally with respect to the bottom surface 20 of the fuel tank 16. In the embodiment, the angle $\alpha$ of the fuel pump 18 is about 40 degrees. In addition, a fuel filter 22 has an axis B that is disposed generally vertically (e.g., at an angle $\theta$ of about 90 degrees with respect to the bottom surface 20 of the tank) and adjacent to the fuel pump 18. The filter 22 filters fuel prior to being delivered to an engine through a flange 23 via tubing (not shown).

The flange 23 of the module 14 is associated with the fuel pump 18 and fuel filter and is mounted to a top wall 25 of the fuel tank 16. The flange 23 permits various fuel piping and electrical connections to pass there-through and enter the tank. Thus, the module 14 has an overall height E from a bottom of a reservoir 24 to a lip 21 of the flange 23 that is generally equal to or less than the height D of the chamber 31 of the fuel tank 16. In the embodiment, the flange 23 is disposed generally above the fuel pump 18.

Figure 2:
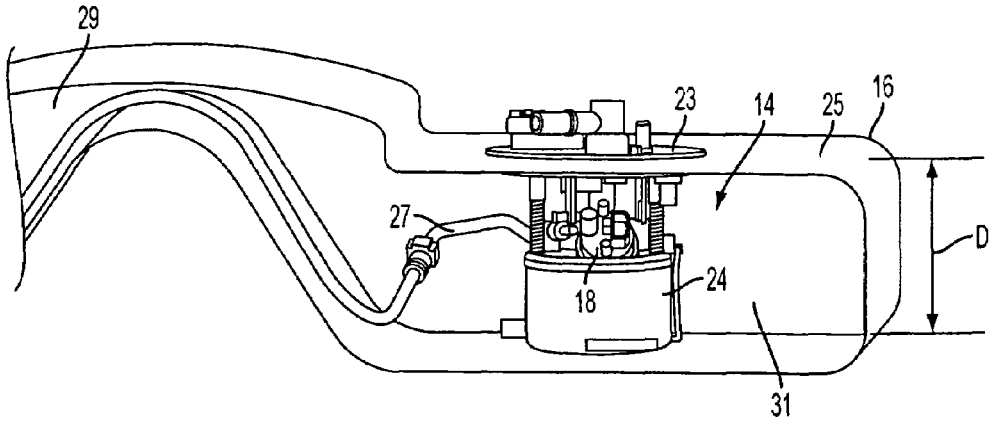
FIG. 2 is a view of a fuel delivery module provided in accordance with an embodiment of the invention, shown mounted in a portion of a saddle-type fuel tank.

In the embodiment, the fuel pump 18 and fuel filter 22 are disposed in the reservoir 24 with the module 14 having a conventional jet pump 26 for creating a vacuum in the conventional manner to draw fuel from the transfer side (chamber 29 in FIG. 2) of the saddle tank 16 via tubing 27 and into the reservoir 24. The flange 23 is coupled to the reservoir 24 via struts 33. For a standard, low profile tank (non saddle-type), the jet pump 26 is not required.

For electrical grounding purposes, a metal member 28 can be attached to the metal retainer of the fuel pump 18 and to a metal retainer of the fuel filter 22. The module 14 can be used in single or dual fuel tank chamber applications.

Thus, the module 14 is configured to be packaged in a low-profile fuel tank since the fuel pump is disposed at an angle and the fuel filter is adjacent to the fuel pump.

The foregoing preferred embodiments have been shown and described for the purposes of illustrating the structural and functional principles of the present invention, as well as illustrating the methods of employing the preferred embodiments and are subject to change without departing from such principles. Therefore, this invention includes all modifications encompassed within the spirit of the following claims.

What is claimed is:

1. A fuel delivery module constructed and arranged to be mounted in a fuel tank of a vehicle, the module comprising:

a fuel pump having an axis constructed and arranged to be disposed generally at an acute angle with respect to a bottom surface of the fuel tank, a fuel filter, a reservoir separate from the fuel tank for containing an amount of fuel, the fuel filter and the fuel pump being disposed in the reservoir with the fuel filter being generally beside the fuel pump, and a flange constructed and arranged to be mounted to a top wall of the fuel tank.

2. The module of claim 1, wherein fuel filter has an axis constructed and arranged to be disposed at an angle of about 90 degrees with respect to the bottom surface of the fuel tank.

3. The module of claim 1, wherein the flange is disposed generally above the fuel pump.

4. The module of claim 1, further including means for grounding the fuel pump and the fuel filter.

5. A fuel delivery module and fuel tank combination comprising:

a fuel tank for a vehicle, the fuel tank having a top wall and a bottom surface, a reservoir mounted to the bottom surface of the fuel tank and separate from the fuel tank, a fuel pump disposed in the reservoir, the fuel pump having an axis disposed generally at an acute angle with respect to the bottom surface of the fuel tank, a fuel filter disposed in the reservoir generally beside the fuel pump, and a flange mounted to the top wall of the fuel tank.

6. The combination of claim 5, wherein fuel filter has an axis disposed at an angle of about 90 degrees with respect to the bottom surface of the fuel tank.

7. The combination of claim 5, wherein the fuel tank is of a saddle-type having a first and second chambers, the first chamber having a certain height, the module being disposed in the first chamber and having a height less than or generally equal to the certain height.

8. The combination of claim 7, further including a jet pump in the reservoir, the jet pump being constructed and arranged to draw fuel from the second chamber into the reservoir.

9. The combination of claim 5, wherein the height of the module is defined as the distance from a bottom of the reservoir to a lip of the flange.

10. The combination of claim 5, wherein the flange is coupled to the reservoir via struts.

11. The combination of claim 5, wherein the flange is disposed generally above the fuel pump.

12. A method of mounting a fuel delivery module in a fuel tank, the method including the steps of:

providing a fuel delivery module having a reservoir separate from the fuel tank, a fuel pump, a fuel filter, and a flange associated with the fuel pump and the fuel filter, mounting the reservoir in the fuel tank with the fuel pump within the reservoir so that an axis of the fuel pump is disposed at an angle less than 90 degrees with respect to a bottom of the fuel tank, mounting the fuel filter in the reservoir generally beside the fuel pump, and mounting the flange to a top wall of the fuel tank.

13. The method of claim 12, wherein the step of mounting the fuel pump includes ensuring that an axis of the fuel pump is disposed at an acute angle with respect to a bottom of the fuel tank.

14. The method of claim 12, wherein the step of mounting the fuel filter includes ensuring that an axis of the fuel filter is disposed at an angle of about 90 degrees with respect to the bottom surface of the fuel tank.

15. The method of claim 12, wherein the fuel pump is mounted so that the flange is disposed generally above the fuel pump.

16. The method of claim 12, further providing placing the fuel pump and fuel filter in the reservoir prior to mounting in the fuel tank.

17. The method of claim 12, wherein the fuel tank is a saddle-type fuel tank.

* * * * *